US005183121A

United States Patent [19]

Koudelka

[11] Patent Number: 5,183,121

[45] Date of Patent: Feb. 2, 1993

[54] SUBMERSIBLE PNEUMATIC DRILLING UNIT

[75] Inventor: Vladimír Koudelka, Krivoklát, Czechoslovakia

[73] Assignee: Permon, státní podnik pan, Krivoklát, Czechoslovakia

[21] Appl. No.: 778,381

[22] Filed: Oct. 16, 1991

[30] Foreign Application Priority Data

Nov. 9, 1990 [CS] Czechoslovakia ..... 5525-90

[51] Int. Cl.[5] ..... E21B 1/00

[52] U.S. Cl. ..... 173/206; 173/135; 173/212; 91/234

[58] Field of Search ..... 173/13, 15, 16, 17, 173/206, 212, 135, 136, 137, 138; 91/234, 300, 321

[56] References Cited

U.S. PATENT DOCUMENTS

| | | | |
|---|---|---|---|
| 2,810,549 | 10/1957 | Morrison | 173/212 |
| 3,225,841 | 12/1965 | Thompson | 173/15 |
| 3,503,459 | 3/1970 | Schindler | 173/136 |
| 3,599,730 | 8/1971 | Tyreso et al. | 173/137 |
| 3,724,560 | 4/1973 | Tibbott | 173/15 |
| 4,790,390 | 12/1988 | Sweeney | 173/17 |
| 4,923,018 | 5/1990 | Meek | 173/135 |

*Primary Examiner*—Frank T. Yost
*Assistant Examiner*—Scott A. Smith
*Attorney, Agent, or Firm*—Notaro & Michalos

[57] ABSTRACT

This heavy duty equipment comprises a working cylinder, a striking piston, an upper lid and a holder of a drill bit. An anterior side duct in the wall of an upper working space of the working cylinder, communicating via an upper filling duct and a posterior side duct with a storage space provided in the upper lid, and an anterior bypass duct communicating via an axial duct in an axial pin and a posterior bypass duct with the storage space, axially define in the upper working space of the working cylinder, a compression space confined by the inner wall of the working cylinder, and further by an anterior face of the upper lid and by the external surface of the axial pin. The upper lid together with the axial pin and the in-built storage space form an assembly group in which a water valve is received.

3 Claims, 2 Drawing Sheets

SUBMERSIBLE PNEUMATIC DRILLING UNIT

FIELD AND BACKGROUND OF THE INVENTION

The invention relates to a heavy-duty submersible pneumatic drilling unit.

With submersible drilling units as well as with all types of pneumatic impact equipments, the intensity of installed capacity is determined by the product of the piston impact energy and the piston motion frequency. Such parameters are given above all by the pressure intensity of supplied air, the size of active piston surfaces alternately engaged by compressed air both in the upper and the lower space of the working cylinder, by the weight and stroke of the striking piston, the applied system of filling and exhausting the working cylinder spaces and, finally, the detailed shape design of the individual equipment parts. With the given intensity of supplied air pressure, the size of active piston surfaces cannot be enhanced by enlarging the working cylinder diameter as it is usual with other types of pneumatic impact equipments. The limitation is given here by the drill hole diameter and the external diameter of the drilling unit, since between the hole wall and the unit an annular space has to be left for raising drillings by exhaust air.

Under these circumstances, practically only one known and real possibility how to markedly enlarge the active surfaces of the striking piston lies in the so-called tandem arrangement of the piston, consisting in that the working cylinder spaces adjacent the two axially arranged piston heads are doubled. With the installed capacity in view, such an arrangement is effective but technologically rather complicated and expensive. Owing to a plurality of cross-sectional changes along the tandem piston axis, a tension concentration occurs in some piston portions, if it is exposed to an impact stress. Proportionally to the piston impact speed also the stress in its critical portions rises up to such a value that at a particular impact speed the stress may exceed the fatigue strength of piston material so that a fatigue fracture may occur. This is why in case of relatively high supply air pressures and consequently high impact speeds, the tandem piston arrangement cannot be used.

Other limits in raising the installed capacity of submersible equipment include the use of a particular system of compressed air distribution. This is the system of filling and exhaust ducts for feeding compressed air into and withdrawing it out of working spaces of the cylinder, respectively. In practice, many distributing systems are used, such as plate, ring, slide and flap valve distributors. Apart from these, some systems without any separate distributing means are known, wherein the working spaces are supplied with compressed air long the surface of or through a bore in the piston. Filling, exhaust and bypass ducts are provided in the wall of the cylinder, or in its liner, in the piston or in a pin passing therethrough, or by combining the above modes. The filling and exhausting function is partially assumed by drilling bits or parts that are connected or associated with them, said parts being specifically shaped for this purpose. Needless to say, all of the embodiments as hereinabove referred to have their advantages and drawbacks which manifest themselves in technical parameters, technology, structure, price, lifetime, etc.

It is an object of all of them to optimalize the piston stroke cycle, which means to obtain the backward stroke within a desired range, to stop the piston in the upper dead center without shock, and to give it for the next impact stroke the necessary impact speed, all of this within an as short a time interval as possible and at a minimum air demand. During its backward motion, the piston makes no work, and the energy it has been given at the start gets wasted in the final phase by counterpressure. Thus in an endeavour to raise the unit output it is advisable to shorten the time interval of the backward stroke motion as much as possible and, consequently, to enhance the piston frequency. This is attainable by intensively braking the piston in its upper dead center as e.g. by compression. High air compression values prevailing in the dead center region after the filling ducts have been closed by the piston head, will not only shorten the piston braking period but give the piston at the same time a high acceleration while starting the impact stroke motion. The compression space created in the upper dead center makes it thus possible to impart to the piston during the backward stroke a higher kinetic energy, to accumulate it and effectively apply it at the start of the impact stroke. In this way it is theoretically possible to raise together with the impact frequency of the piston also the energy thereof whereby the installed unit capacity increases. In practice, however, a considerable portion of the backward stroke energy accumulated in the compression space is dissipated due to leakage between the piston and the cylinder, and to a heat removal. As the piston starts its impact stroke the compressed air expands, and at the instant of opening the compression space the pressure does not recover, owing to such losses, its original value at the start of compression drops to a substantially lower one. After the compression space has been opened during the impact stroke, the piston, due to a high acceleration, has already a considerable speed so that a relatively rapid change in the volume of the upper working space in the cylinder occurs. Under these circumstances, compressed air supplied through blocked profiles of filling ducts does not suffice to refill the upper working space of the cylinder so that during the remaining impact stroke phase this space is imperfectly supplied with compressed air. This impairs the piston velocity increase during the remaining stroke phase and negatively influences the impact speed and energy. The resulting effect of energy accumulation during the backward stroke gets lost and the efficiency of energy transfer from the backward stroke to the impact stroke drops.

SUMMARY OF THE INVENTION

It is an object to the present invention to eliminate the disadvantages of the prior art as hereinabove set forth and to provide a submersible pneumatic drilling unit, comprising a working cylinder a striking piston, an upper lid and a drill bit holder.

According to the invention, an anterior side duct in the wall of an upper working space of the working cylinder, communicating via an upper filling duct and a posterior side duct with a storage space provided in the upper lid, and an anterior bypass duct communicating via an axial duct in an axial pin and a posterior bypass duct with the storage space, axially define in the upper working space of the working cylinder a compression space confined by the inner wall of the working cylinder, by an anterior face of the upper lid and by the external surface of the axial pin. The upper lid together with the axial pin and the built-in storage space are for an assembly group in which a water valve is received. The valve comprises a valve spring, a valve ball and a valve seat inserted in a recess in an inlet duct whose diameter is greater than that of the valve ball.

The unit enables, according to the invention, a part of the kinetic energy of the piston backward stroke to be accumulated in said compression space and to be efficiently transmitted to the piston at the start of the impact stroke thereof without any marked air pressure drop in said upper working space as the impact stroke continues. A potential air pressure drop in the upper working space resulting from the untightness of the compression space, heat removal and the insufficient profile of the upper filling duct, is compensated for by adding pressurized air from the storage space via bypass ducts and the axial pin cavity whereas compressed air from the supply duct is conveyed to said upper working space as well as to said storage space in a usual way through the upper filling duct.

Due to high compression values, the time interval of the piston stop and start, respectively, is very short, which together with the proper filling of the upper working space during the impact stroke, means an increase of piston frequency as well as a higher impact speed and power. Thus the invention makes it possible to substantially raise the installed capacity of the submersible pneumatic drilling unit. The unit is compact, not complicated, inexpensive in manufacture and insensitive to work conditions, attendance and maintenance. Apart from this, the unit is operable under any air pressure supplies available.

With regard to the assembly and maintenance it is preferable if the entire upper lid, from the connecting thread up to the axial pin, forms an integer part. This, above all, enables the threaded top portion of the working cylinder to be variously dimensioned, since the relative position of said upper lid and the working cylinder is axially defined by the outer face of the working cylinder without the necessity of additional shouldering and providing any other inner front face which in case of mounting several parts axially one after the other, would be indispensable. Thus a beneficial feature of the unit is also a marked increase of lifetime, particularly owing to a higher fatigue strength of the critical portion and, consequently, of the complete unit. It, therefore, can be stated that the invention enables both the installed capacity of the submersible pneumatic drilling unit and the lifetime thereof to be increased simultaneously.

Into the upper lid provided according to the present invention, a water valve can preferably be installed, in order to prevent water from penetrating into the unit when operating in water-bearing beds. Such valve is of a simple structure, and easily removable in cases there the unit is not endangered by water infiltration. In these cases the unit need not be disassembled.

BRIEF DESCRIPTION OF THE DRAWINGS

In order that the invention be better understood and carried into practice, a preferred embodiment thereof will hereinafter be described in the accompanying schematic drawings wherein.

DESCRIPTION OF THE PREFERRED EMBODIMENTS

Figure 1:
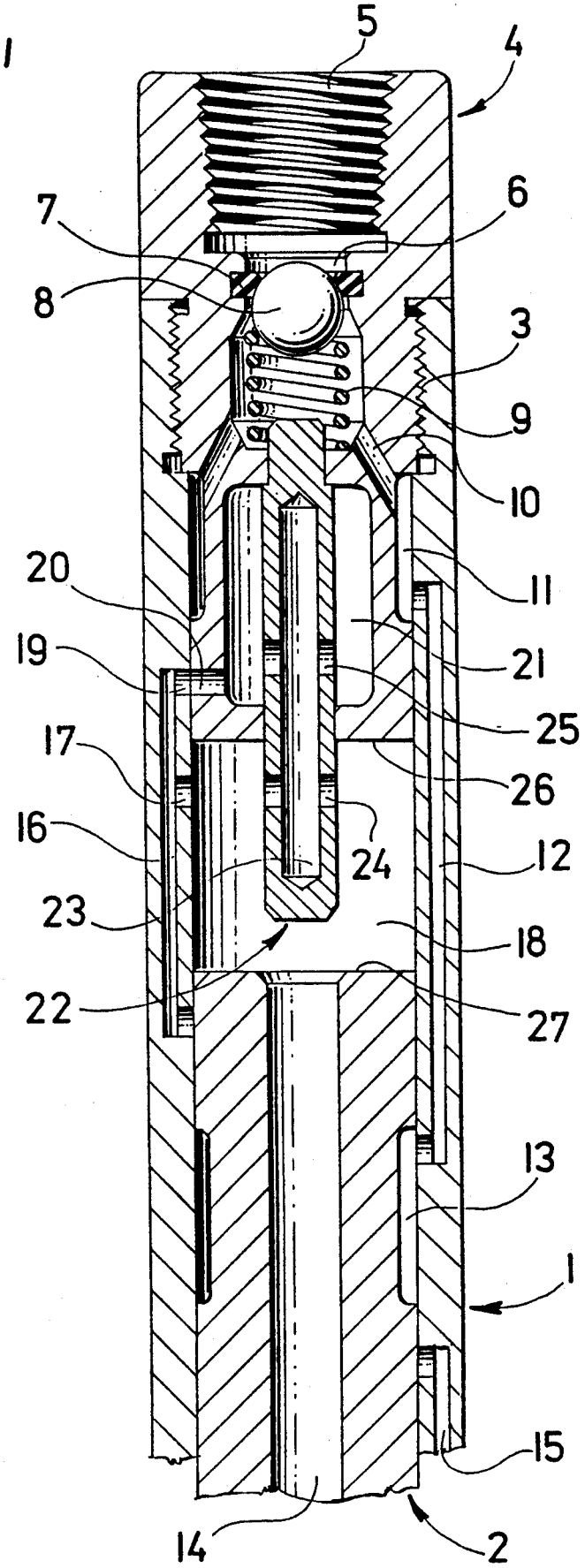
FIG. 1 is an axial sectional view of the upper part of the unit according to the present invention.
Figure 2:
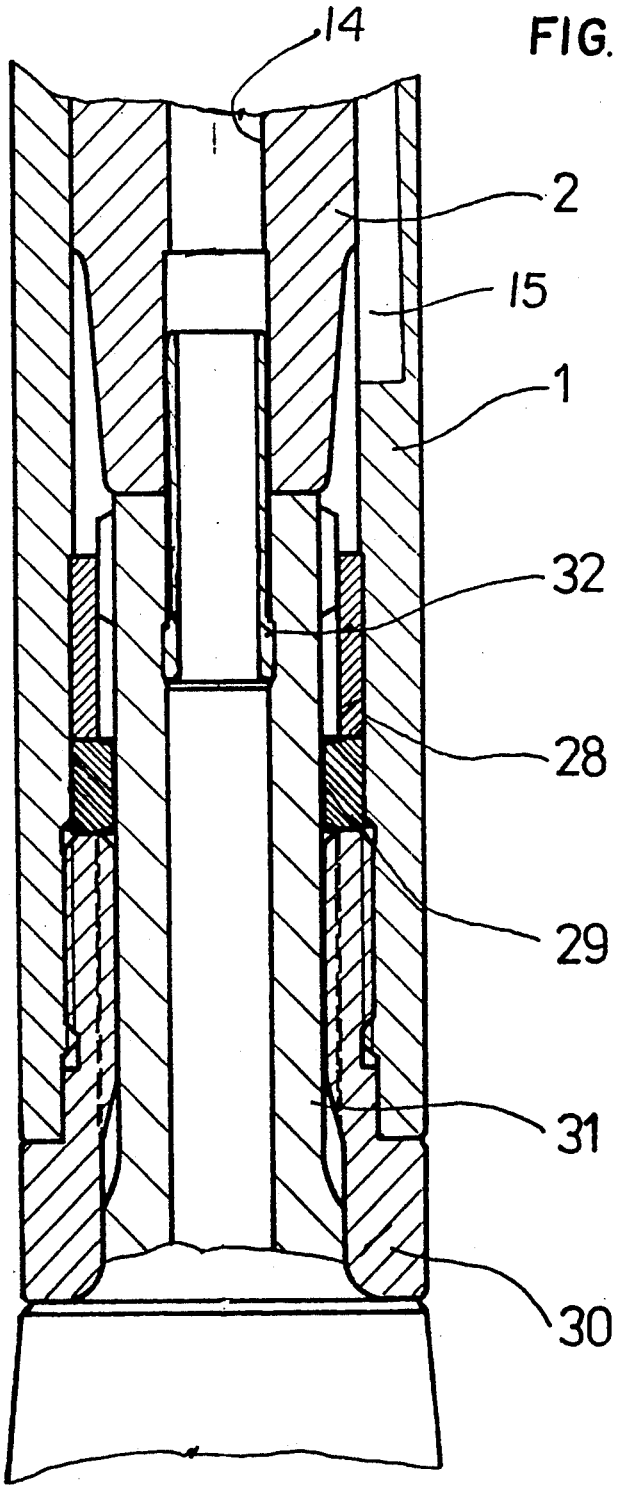
FIG. 2 is an axial sectional view of the lower part of the unit.

As can be seen in the FIG. 1, a striking piston 2 is mounted for reciprocation in a working cylinder 1. At its top, cylinder 1 is closed by an upper lid 4 by means of a female thread 3 while at its lower end shown in FIG. 2, cylinder 1 has a guide 28, a snap ring 29 and a holder 30 for a drill bit 31. Piston 2 has an exhaust port 14 which opens into an exhaust tube 32. The top portion of said upper lid 4 is provided with a connecting thread 5 for coupling the unit to a drill pipe (not shown). In an inlet duct 6 of the upper lid 4 there is mounted in a recess an elastic valve seat 7 forming a support for a valve ball 8 forced by a valve spring 9 into said valve seat 7. The space receiving the valve ball 8 and the valve spring 9 communicates via skew conduits 10, a feeding recess 11 and a supply duct 12 with a distributing recess 13 in the striking piston 2. The exhaust port 14 extends on the axis of the striking piston 2. The inner wall of the working cylinder 1 is provided with a lower filling duct 15 communicating with the lower working space of the working cylinder 1, as shown in FIG. 2. The inner wall is also provided with an upper filling duct 16 communicating via an anterior side duct 17 with an upper working space 18 of the working cylinder, and via a posterior side duct 19 with a radial duct 20 and a storage space 21 provided in the upper lid 4. The storage space 21 encloses an axial pin 22 secured in the upper lid 4. The pin 22 is provided with an axial duct 23 communicating via an anterior bypass duct 24 with the upper working space 18 of the working cylinder 1, and via a posterior bypass duct 25 with said storage space 21. An anterior face 26 of the upper lid 4 closes the upper working space 18 of the working cylinder 1. In the top portion of the upper working space 18 there is provided a compression space confined by the anterior face 26 of the upper lid 4, the inner wall of the working cylinder, and the external surface of said axial pin 22. In the direction away from a posterior face 27 of the striking piston 2, the compression space is defined by upper edges of the anterior side duct 17 and the anterior bypass duct 24. During the motion of the striking piston backwards to the anterior face 26 the compression space, after the anterior side duct 17 and the anterior bypass duct 24 have been covered, is closed by the posterior face 27 of the striking piston 2.

After the unit has been supplied with compressed air, the valve ball 8 will let it flow into skew conduits 10, the feeding recess 11, the supply duct 12 and the distributing recess 13. Depending upon the instataneous position of the striking piston 2, compressed air is led from said distributing recess 13 either through the lower filling duct 15 to the lower working space of the working cylinder 1, or—according to the piston position shown in the drawing—through the upper filling duct 16 to the upper working space 18 of the working cylinder 1. In this way the reciprocation of the striking piston 2 is accelerated. After an impact on the drill bit 31 in the bottom dead center of its stroke, the striking piston 2 is accerelated by a pressure in the lower working space of the working cylinder 1 in its backward motion to the anterior face 26 of the upper lid 4. At a particular length of backward stroke, the distributing recess 13 of the striking piston 2 will cut off the compressed air supply to the not shown lower working space of the working cylinder 1. As the backward stroke continues after closing the exhaust port 14 by the axial pin 22, the striking piston 2 will let by its distributing recess 13 the compressed air flow in the upper filling duct 16 and from it through the anterior side ducts 17 into the upper working space 18 of the working cylinder 1. Simultaneously, the compressed air is supplied through the upper filling duct 16, the posterior side duct 19 and the radial duct 20 also into the storage space 21. Air pressure in the upper working space 18 and in the storage space 21 is compensated for by means of the anterior bypass duct 24, the axial duct 23 and the posterior bypass duct 25. During its backward stroke, the striking piston 2 is braked by compressed air which engages its posterior face 27 in the upper working space 18. In a particular phase of the backward stroke, the bottom portion of the striking piston 2 will open in a usual way the exhaust port 14 leading out of the lower working space of the cylinder. By inertia, the striking piston 2 continues in its braked backward stroke, till—adjacent the top dead center—it closes the anterior side duct 17 as well as the anterior by-pass duct 24. During the next phase of the backward stroke, the striking piston 2 is braked by air compression in the space defined by the anterior face 26 of the upper lid 4, the inner surface of upper working space 18 of the working cylinder 1, the outer surface of the axial pin 22 and the posterior face 27 of the striking piston 2. In this compression space the pressure rises as long as the striking piston 2 stops in the upper dead center adjacent the anterior face 26. Due to the compression, the striking piston 2 is accelerated since this moment in its forward motion, i.e. up to the impact. During this phase of piston motion, compressed air is supplied through the upper filling duct 16, the posterior side duct 19 and the radial duct 20 into the storage space 21, including the spaces of the posterior bypass duct 25, the axial duct 23 and the anterior bypass duct 24. The air pressure in the compression space will impart to the striking piston 2 a high acceleration so that at the instant of opening the anterior side duct 17 and the anterior bypass duct 24 the striking piston 2 possesses a considerable velocity. During the motion of the striking piston 2, the escape of a certain volume of compressed air out of the compression space occurs, due to a leakage caused by a play between the outer wall of the piston 2 and the inner wall of the working cylinder 1 as well as to a leakage of the exhaust port 14 in the axial pin 22.

Apart from a heat removal through the surface of the compression space, such air escaping results in a pressure drop in said space so that the air pressure value therein is, at the end of compression substantially lower than at the beginning thereof. This fact, together with the afore-mentioned considerable velocity of the striking piston 2 at the instant of opening the compression space and with a rapid change of capacity of the upper working space 18 resulting therefrom, would lead, in the absence of the storage space 21, to an imperfect filling of the upper working space 18 within the entire remaining phase of the impact stroke. According to the invention, however, the compressed air is withdrawn out of the storage space 21 filled up during the compression stroke, and supplied through the posterior bypass duct 25, the axial duct 23 and the anterior bypass duct 24 to the upper working space 18 where it suffices, together with the compressed air being fed into the upper working space 18 via the upper filling duct 16 and the anterior side duct 17, to perfectly fill up said upper working space 18. As the impact stroke continues, the upper working space 18 is being sufficiently filled so that the striking piston 2 is given a desired acceleration, speed and impact energy. Owing to a relatively high compression value, the stopping and starting periods of the striking piston 2 in the upper dead center are very short whereby the impact frequency rises. Due to the pressure addition by withdrawing compressed air from the storage space 21, it is made possible to generate relatively high energy of the striking piston 2 whereby the installed capacity of the submersible unit is substantially enhanced. Thus, according to the invention, the piston is intentionally given, during its backward stroke motion, a higher energy than it is usual with well-known units of the kind whereupon the energy accumulated in the compression space is imparted to the striking piston during its impact stroke.

I claim:

1. A submersible pneumatic drilling unit, comprising:

a working cylinder having an inner wall, an upper end and a lower end;

a striking piston moveably mounted in said cylinder;

an upper lid closing the upper end of said cylinder and defining with said striking piston and upper working space in said cylinder, the upper lid having a storage space therein;

a drill bit holder connected to the lower end of said cylinder for holding a drill bit to be struck by said striking piston;

an upper filling duct extending in said working cylinder;

an anterior side duct in said working cylinder communicating said upper working space with said upper filling duct;

a posterior side duct in said working cylinder communicating said storage space in the upper lid with said upper filling duct;

an axial pin containing an axial duct therein, said axial pin extending in said storage space of said upper lid, and into said upper working space;

an anterior by-pass duct in said axial pin for communicating said axial duct in said axial pin with said upper working space;

a posterior by-pass duct in said axial pin for communicating said axial duct of said axial pin with the storage space of said upper lid; and said upper working space forming a compression space between the inner wall of said working cylinder, an anterior face of said upper lid, an external surface of said axial pin, and a posterior face of said striking piston so that when said striking piston moves upwardly in said cylinder, pneumatic fluid in the upper working space moves through said anterior by-pass duct and through said interior side duct, into said storage space.

2. A unit according to claim 1, wherein said upper lid with said storage space, and said axial pin, form an assembly which is connected as one part to the upper end of said working cylinder.

3. A unit according to claim 1, including a valve in said upper lid above said storage space, said valve comprising a valve seat in said upper lid, a valve ball moveable in said upper lid into and out of engagement with said valve seat, and a valve spring engaged against said valve ball for urging said valve ball against said valve seat, said upper lid including an inlet duct having a diameter which is greater than a diameter of said valve ball and on an opposite side of said valve seat with respect to said valve ball for receiving pneumatic fluid into said upper lid.

* * * * *